US007359667B2

(12) United States Patent
Kwak et al.

(10) Patent No.: US 7,359,667 B2
(45) Date of Patent: Apr. 15, 2008

(54) DEVICE FOR HEATING FUSING AND PRESSURE ROLLER USING INDUCTIVE-HEAT IN A FUSING DEVICE FOR AN IMAGE FORMING APPARATUS

(75) Inventors: In-gu Kwak, Suwon-si (KR); Il-han Park, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/943,148

(22) Filed: Sep. 17, 2004

(65) Prior Publication Data

US 2005/0063744 A1 Mar. 24, 2005

(30) Foreign Application Priority Data

Sep. 20, 2003 (KR) ..... 10-2003-0065407

(51) Int. Cl.
*G03G 15/20* (2006.01)

(52) U.S. Cl. ..... 399/330; 219/216; 219/672

(58) Field of Classification Search ..... 399/328, 399/330, 331, 333; 219/216, 619, 647, 650, 219/652, 670, 672, 659
See application file for complete search history.

(56) References Cited

U.S. PATENT DOCUMENTS 6,246,036 B1 * 6/2001 Tsujimoto et al. ..... 219/619
6,320,168 B1 * 11/2001 Kimata et al. ..... 399/330
6,336,027 B1 * 1/2002 Sakai et al. ..... 399/328
6,341,211 B1 1/2002 Tsujimoto et al. ..... 399/330
6,661,991 B2 * 12/2003 Naito et al. ..... 399/328
6,816,698 B2 * 11/2004 Morihara ..... 399/328

FOREIGN PATENT DOCUMENTS

JP 61261763 A * 11/1986
JP 08-076622 3/1996
JP 10-031389 2/1998
JP 10-123862 5/1998

OTHER PUBLICATIONS

English translation of JP 61-261763.*

* cited by examiner

*Primary Examiner*—David M. Gray
*Assistant Examiner*—Ruth LaBombard
(74) *Attorney, Agent, or Firm*—Roylance, Abrams, Berdo and Goodman, LLP

(57) ABSTRACT

A fusing device for an image forming apparatus including a cylindrical fusing roller, a pressure roller installed opposite to the fusing roller and pressing a sheet of paper passing therebetween, and an inductive heating element simultaneously heating the fusing roller and the pressure roller. The fusing device reduces the time to reach a fusing temperature by heating both the fusing roller and the pressure roller with a closed magnetic core extending between hollow portions of each.

11 Claims, 6 Drawing Sheets

DEVICE FOR HEATING FUSING AND PRESSURE ROLLER USING INDUCTIVE-HEAT IN A FUSING DEVICE FOR AN IMAGE FORMING APPARATUS

CROSS-REFERENCE TO RELATED APPLICATIONS

This application claims the benefit under 35 U.S.C. §119 (a) of Korean Patent Application No. 2003-65407, filed in the Korean Intellectual Property Office on Sep. 20, 2003, the entire contents of which are incorporated herein by reference.

BACKGROUND OF THE INVENTION

1. Field of the Invention

The present invention relates to a fusing device for an image forming apparatus. More particularly, the present invention relates to a fusing device for an image forming apparatus which has an element for inductive-heating a fusing roller and a pressure roller.

2. Description of the Related Art

Generally, an image forming apparatus such as a copier, printer, facsimile or multifunctional machine combining the functions of the previous devices in a single system, is commonly provided with a printer function.

The image forming apparatus includes a fusing device for heating a sheet of paper where a toner image is transferred, and fixing the toner image to the sheet of paper by instantly melting the toner image in a powder state. The fusing device includes a fusing roller for fusing toner on a sheet of paper and a pressure roller for pushing the sheet of paper toward the fusing roller.

The fusing roller melts toner at a predetermined temperature, for example, at 180° C. The fusing roller can be heated by means of a halogen lamp, heating coil, or an inductive-heating coil.

FIGS. 1 and 2 show the structure of an inductive-heating fusing device disclosed in U.S. Pat. No. 6,341,211, issued Jan. 22, 2002, to Tsujimoto et al., the entire contents of which are incorporated herein by reference. FIG. 1 is a vertical cross-sectional view of the inductive-heating fusing device, and FIG. 2 is a cross-sectional view of an inductive fusing portion shown in FIG. 1.

Referring to FIGS. 1 and 2, the fusing device includes a fixed hollow conductive member 12 thermally fusing toner 11 on a sheet of paper, a pressure roller 13 pushing the sheet of paper 10 containing the toner 11 toward the conductive member 12, a conveyor belt 20 carrying the sheet of paper 10 interposed between the fixed conductive member 12 and the pressure roller 13, and a coil 14 inductively heating the conductive member 12. The conveyor belt 20 moves in a direction A, and the pressure roller 13 is rotated in a direction B according to the rotation of the conveyor belt 20.

The conductive member 12 is formed of a hollow pipe, for example, a carbon steel pipe, stainless alloy pipe, aluminum pipe, or an iron pipe. The pressure roller 13 includes a cylindrical roller 15 and a silicon rubber layer 16 formed on the circumference of the cylindrical roller 15. The pressure roller 13 is pressed toward the conductive member 12 by means of a spring member (not shown).

Reference number 17 denotes a rectangular core forming a closed magnetic circuit part which penetrates the hollow portion 12*a* of the conductive member 12. The coil 14 is wound around the core 17. When a current passes through the coil 14, a magnetic flux is created which generates an inductive current around the conductive member 12. The core 17 can be an iron core having a high coercive coefficient used in a general transformer.

Reference number 22 denotes a heat insulating layer, which prevents heat produced from the conductive member 12 and the coil 14 from being transferred to the core 17.

The operation of the fusing device as constructed above is described in greater detail below with reference to the appended drawings.

When an alternating current having a frequency of tens or hundreds of Hz is applied from a power circuit (not shown) to the coil 14 winding around the core 17, an AC magnetic flux is generated at the core 17. The magnetic flux produces an inductive current around the conductive member 12 located adjacent to the magnetic flux. The inductive current generates heat in accordance to Joules Law as known to those skilled in the art. The conductive member 12 is heated by the low-frequency inductive heat to a temperature appropriate for fusing, which ranges, for example, between 150° C. and 200° C. When the sheet of paper 10 having the unfused toner 11 passes between the conductive member 12 and the pressure roller 13, the unfused toner 11 melts and fixes on the sheet of paper 10 by the heat of the conductive member 12 and the pressure of the pressure roller 13.

FIG. 3 illustrates another example of an inductive-heating fusing device disclosed in U.S. Pat. No. 6,341,211, referenced above. Reference numerals in FIG. 3 denote the same elements as in FIGS. 1 and 2 and further denote a nipping area 19.

While the core 17 and the conductive member 12 are rectangular in FIGS. 1 and 2, the conductive member 12' of FIG. 3 is a cylindrical roller. Since other elements in FIG. 3 are substantially identical to those in FIGS. 1 and 2, detailed descriptions thereof will be omitted.

The fusing device applies inductive heat to the conductive member 12, however, the heat produced at a portion of the core 17 around which the coil 14 is not wound, dissipates into the air, resulting in an undesired thermal loss. The pressure roller 13, indirectly contacting the conductive member 12, also absorbs heat from the conductive member 12 while attaching the sheet of paper 10 thereto, thereby resulting in an undesired thermal loss as well.

However, in the case of a printer which requires rapid fusing heat, such as a color laser printer, high-speed laser printer or a laser printer printing large sheets of paper at a high speed, the pressure roller needs to be heated.

Accordingly, a need exists for a system and method to reduce thermal losses resulting from dissipating heat, and directing dissipating heat to efficiently heat the pressure roller where required.

SUMMARY OF THE INVENTION

Accordingly, the present invention has been made to solve the above and other problems. The present invention provides a fusing device for an image forming apparatus which reduces thermal loss by dissipating heat, generated at a core by inductive heating, into a pressure roller to heat the pressure roller to a predetermined temperature.

The present invention also provides a fusing device for an image forming apparatus which enables high-speed printing by reducing a thermal load of a fusing roller by additionally heating a pressure roller by inductive heating.

According to an object of the present invention, a fusing device for an image forming apparatus is provided, the fusing device comprising a cylindrical fusing roller, a pressure roller installed opposite to the fusing roller and pressing a sheet of paper passing therebetween, and an inductive heating element simultaneously heating the fusing roller and the pressure roller.

The inductive heating element can comprise a core passing through hollow portions of the fusing roller and the pressure roller to form a closed magnetic circuit, a coil spirally wound around the circumference of the core, and an AC power source applying a predetermined AC voltage to both ends of the coil.

The coil can be wound around a portion of the core inside the hollow portion of the fusing roller. The fusing device can further comprise a heat insulating layer between the coil and the core.

According to another object of the present invention, a fusing device for an image forming apparatus is provided, the fusing device comprising a cylindrical fusing roller, a pressure roller installed opposite to the fusing roller and pressing a sheet of paper passing therebetween, an inductive heating element heating the fusing roller, and an element heating the pressure roller.

The inductive heating element can comprise a first core, a portion of which passes through a hollow portion of the fusing roller forming a closed magnetic circuit, a first coil spirally wound around the circumference of the first core, and an AC power source applying a predetermined AC voltage to both ends of the first coil.

The element heating the pressure roller can comprise a second core passing through a hollow portion of the pressure roller forming a closed magnetic circuit, a second coil spirally wound around the circumference of the second core, and an AC power source applying a predetermined AC voltage to both ends of the second coil.

BRIEF DESCRIPTION OF THE DRAWINGS

The above and other objects, features and advantages of the present invention will become more apparent by describing in detail exemplary embodiments thereof with reference to the attached drawings in which.

In the figures, it will be understood that like reference numerals refer to like features and structures.

DETAILED DESCRIPTION OF THE EXEMPLARY EMBODIMENTS

Figure 1:
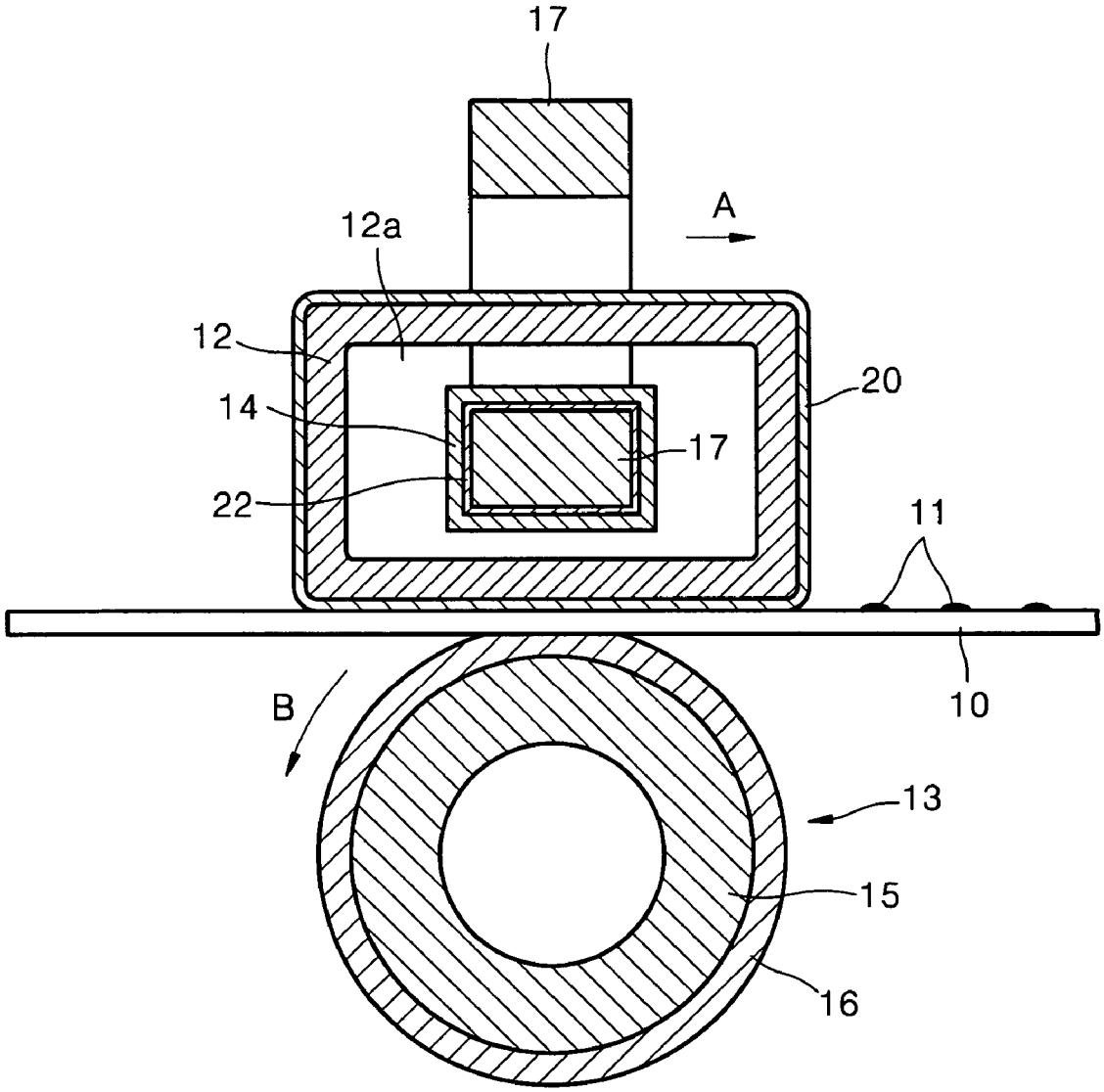
FIG. 1 (PRIOR ART)
FIGS. 1 and 2 are cross-sectional views of an example conventional inductive-heating fusing device.
Figure 2:
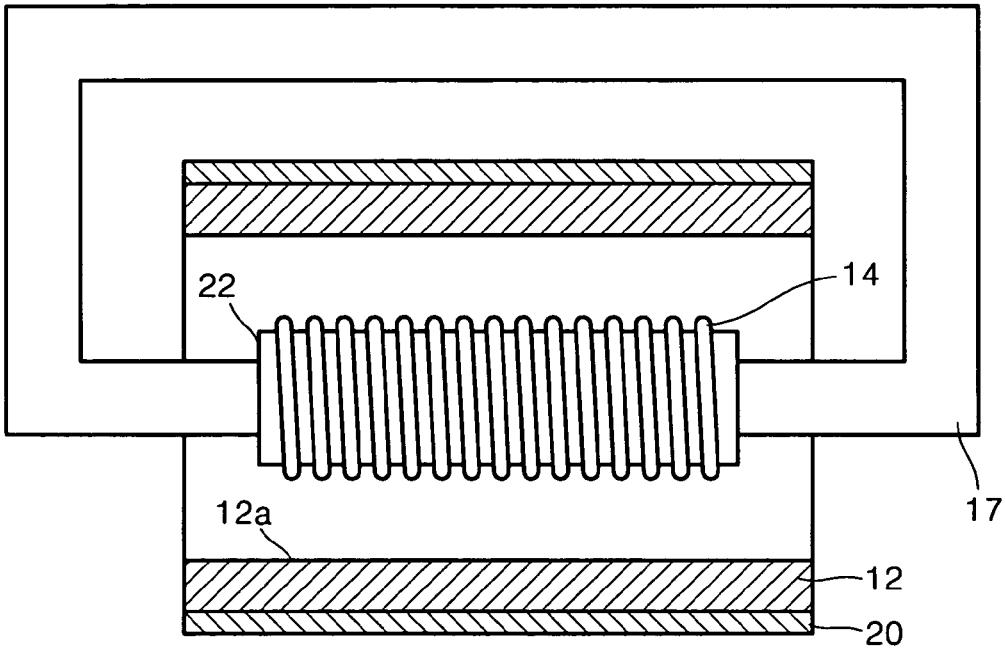
FIG. 2 (PRIOR ART)
Figure 3:
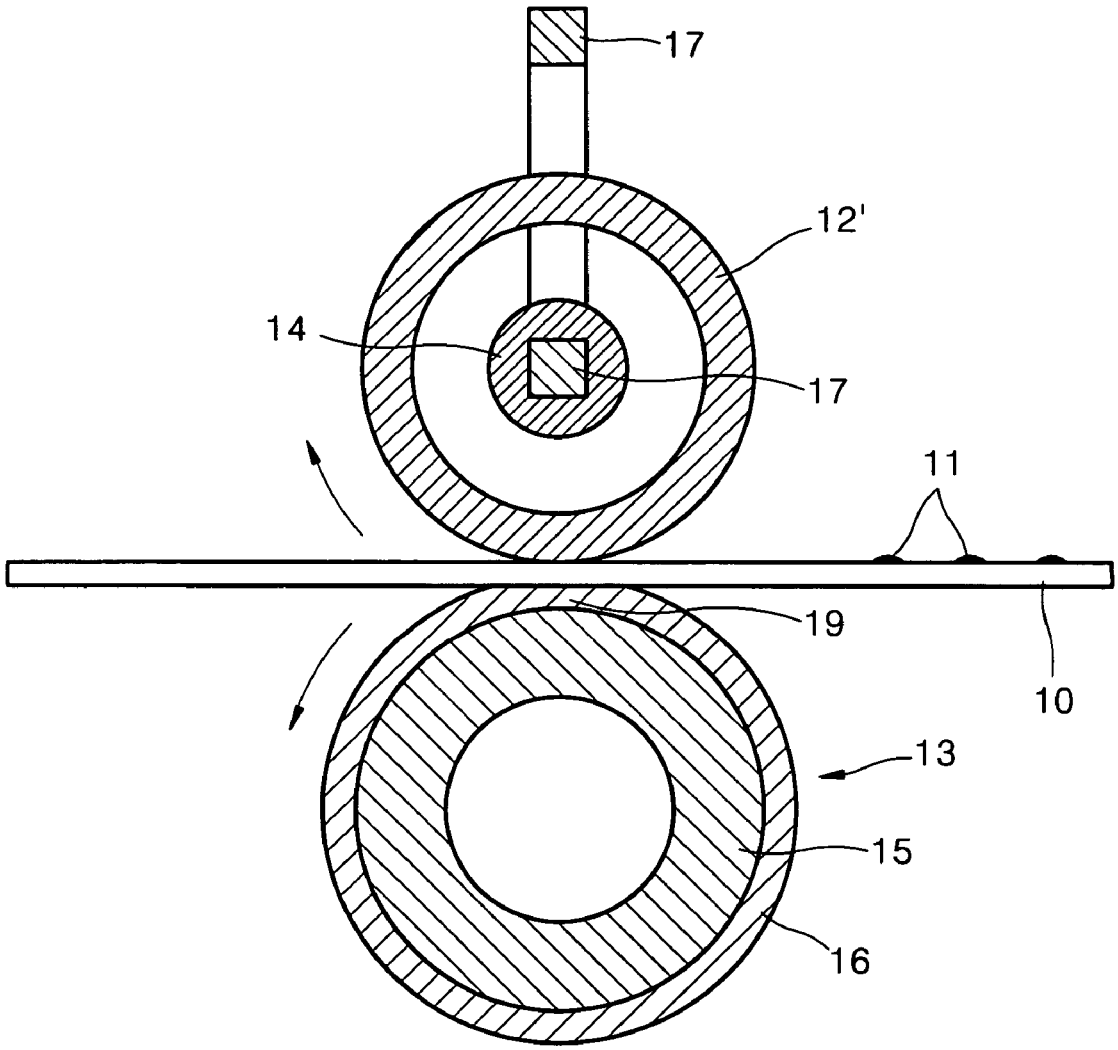
FIG.3 (PRIOR ART)
FIG. 3 is a cross-sectional view of another conventional inductive-heating fusing device.

Hereinafter, the present invention will be described in detail by explaining exemplary embodiments thereof with reference to the appended drawings. In the drawings, the thickness of layers and areas are exaggerated for clarity.

Figure 4:
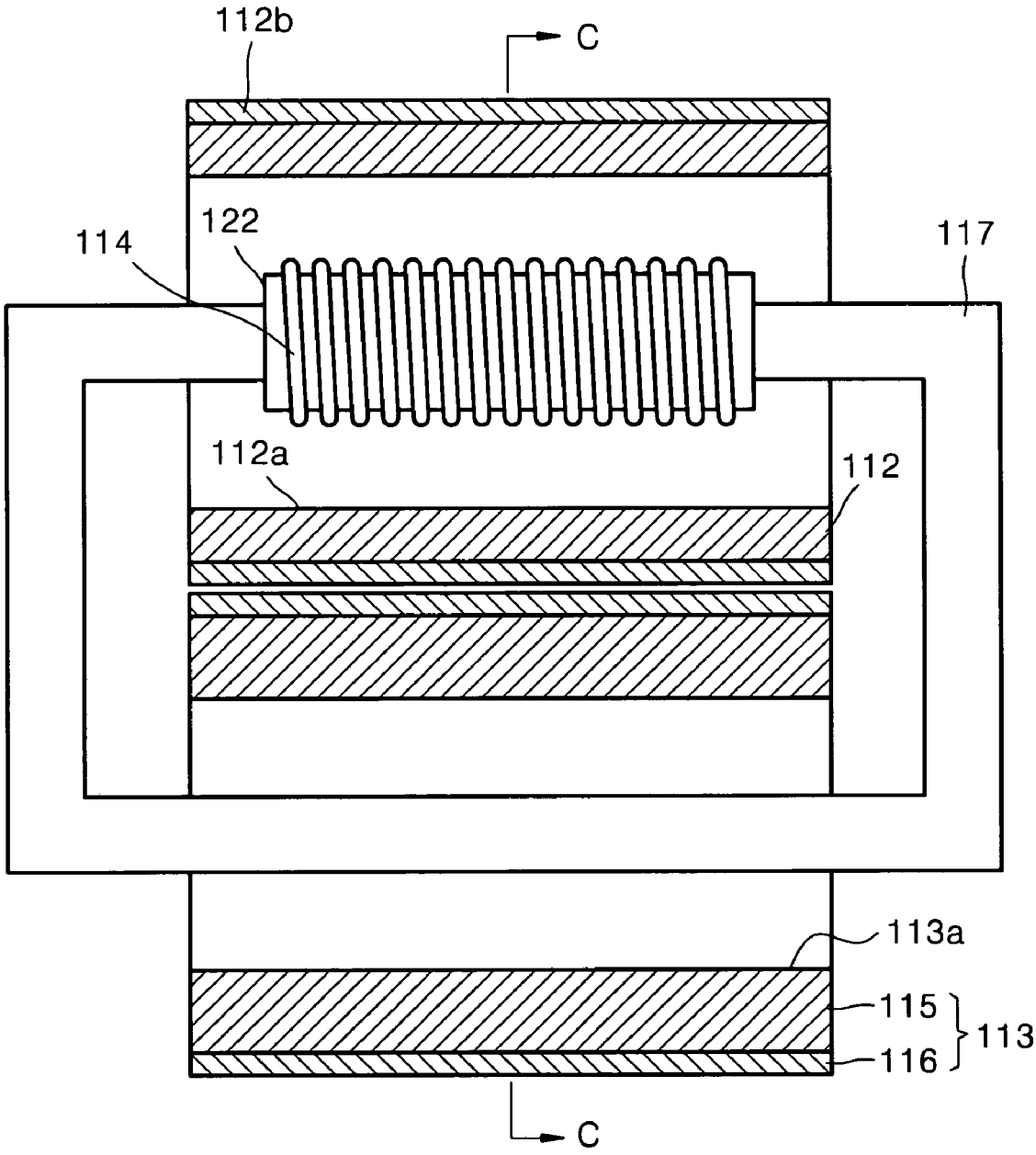
FIG. 4 is a cross-sectional view of a fusing device for an electrophotographic image forming apparatus according an embodiment of the present invention.
Figure 5:
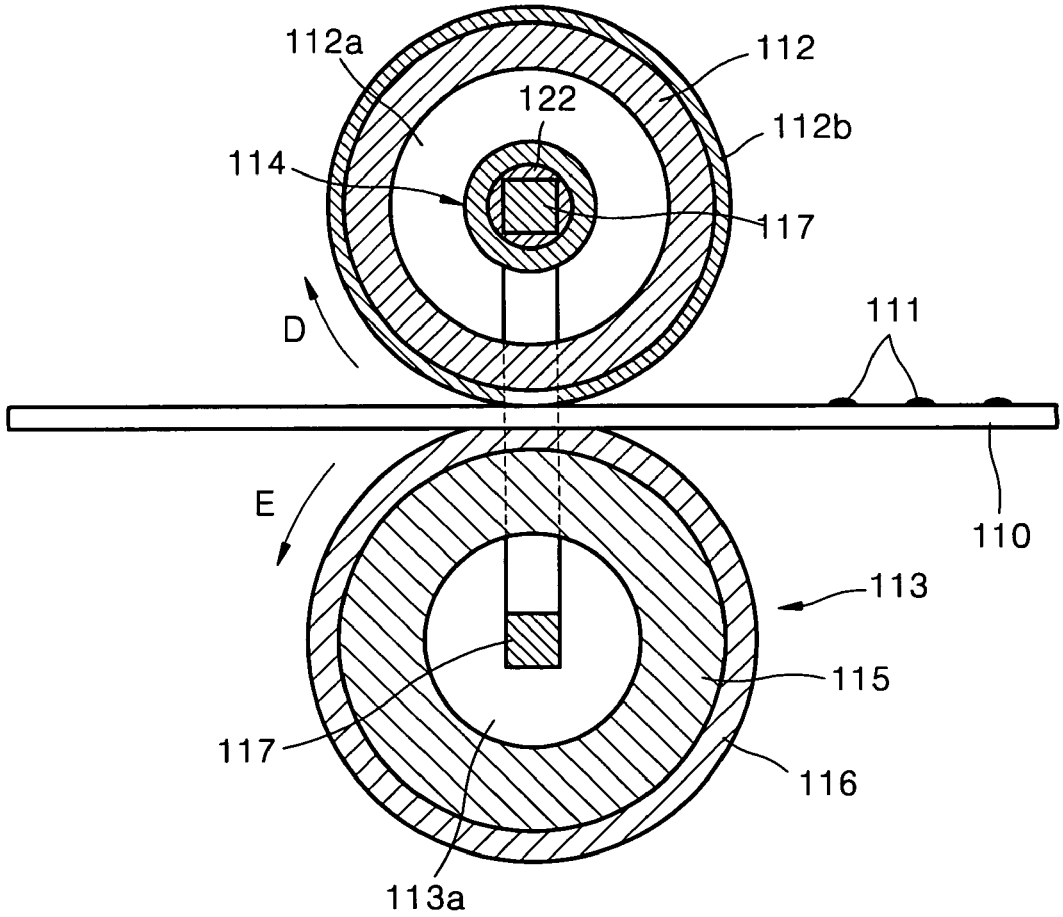
FIG. 5 is a cross-sectional view of the fusing device of FIG. 4 taken along line C-C.

Referring to FIGS. 4 and 5, a fusing device for an electrophotographic image forming apparatus according to a first embodiment of the present invention includes a cylindrical hollow fusing roller 112 installed to be rotatable by a driver (not shown) in order to melt toner 111 on a sheet of paper 110, a hollow pressure roller 113 pressing the sheet of paper 110 containing the toner 111 toward the fusing roller 112, a core 117 connecting a hollow portion 112*a* of the fusing roller 112 with a hollow portion 113*a* of the pressure roller 113, and a coil 114 wound around a circumference of the core 117 in order to inductively heat the fusing roller 112.

The fusing roller 112 can be a hollow pipe made of a conductive material such as carbon steel, stainless alloy, aluminium, or iron. The fusing roller 112 can further have a Teflon coating layer 112*b* on the circumference thereof as a toner release layer for contacting the toner 111 on the sheet of paper 110. The fusing roller 112 can rotate in a direction D, and the pressure roller 113 can be rotated in a direction E by being engaged with the fusing roller 112, and not requiring an additional driver.

Like the fusing roller 112, the pressure roller 113 includes a cylindrical roller 115 made of a conductive material and having a silicon rubber layer 116 formed on the circumference of the cylindrical roller 115. The pressure roller 113 is pushed toward the fusing roller 112 by a spring member (not shown).

A rectangular core 117 is used to inductively heat the fusing roller 112. A portion of the core 117 passes through the hollow portion 112*a* of the fusing roller 112 and another portion of the core 117 passes through the hollow portion 113*a* of the pressure roller 113. The core 117 forms a closed magnetic circuit.

The coil 114 is wound around the circumference of the core 117 passing through the fusing roller 112. The coil 114 has a predetermined number of turns. A heat insulating layer 122, for example, a mica sheet, is wound between the core 117 and the coil 114. The heat insulating layer 122 prevents heat produced at the fusing roller 112 and the coil 114 from being transferred to the core 117.

When an AC voltage is applied to the coil 114 from an AC power source (not shown), a magnetic flux is created which produces an inductive current along the circumference of the fusing roller 112 and the pressure roller 113. The core 117 can be an iron core having a high coercive coefficient used in a general transformer. The fusing roller 112 is then heated to a fusing temperature, for example, 180° C., by the inductive current.

The fusing roller 112 is configured to be heated by the heat generated by the inductive current of the fusing roller 112 and by the heat produced by the coil 114 and the core 117. However, the pressure roller 113 is heated to a lower temperature, for example, 150° C., because the pressure roller 113 is configured to be heated only by the heat produced by the inductive current of the cylindrical roller 115 through induction by the core 117. The difference in temperature between the fusing roller 112 and the pressure roller 113 can be determined by the number of turns of the coil 114 and the frequency and voltage of the AC power source applied to the coil 114.

The operation of the fusing device constructed as above will be described in greater detail below with reference to the appended drawings.

When an AC current with a frequency of tens or hundreds of Hz is applied to the coil 114 from an AC power source (not shown), an AC magnetic flux is generated around the core 117. The magnetic flux produces an inductive current along the circumference of the fusing roller 112, which is made of a conductive material. The inductive current produces heat according to Joule's Law as known to those skilled in the art. The fusing roller 112 is heated by the low-frequency inductive heat to a temperature appropriate for fusing, for example, between 150° C. and 200° C.

The fusing roller 112 is heated to a temperature appropriate for fusing, for example, 180° C., while the pressure roller 113 is heated to a temperature which is lower than the temperature of the fusing roller 112, for example, 150° C.

When the sheet of paper 110 containing unfused toner 111 is fed into the fusing device maintained at a predetermined fusing temperature (between the fusing roller 112 and the pressure roller 113), the unfused toner 111 melts from the heat of the fusing roller 112 and the pressure roller 113, and is thereby fixed on the sheet of paper 110 due to the pressure of the pressure roller 113.

Figure 6:
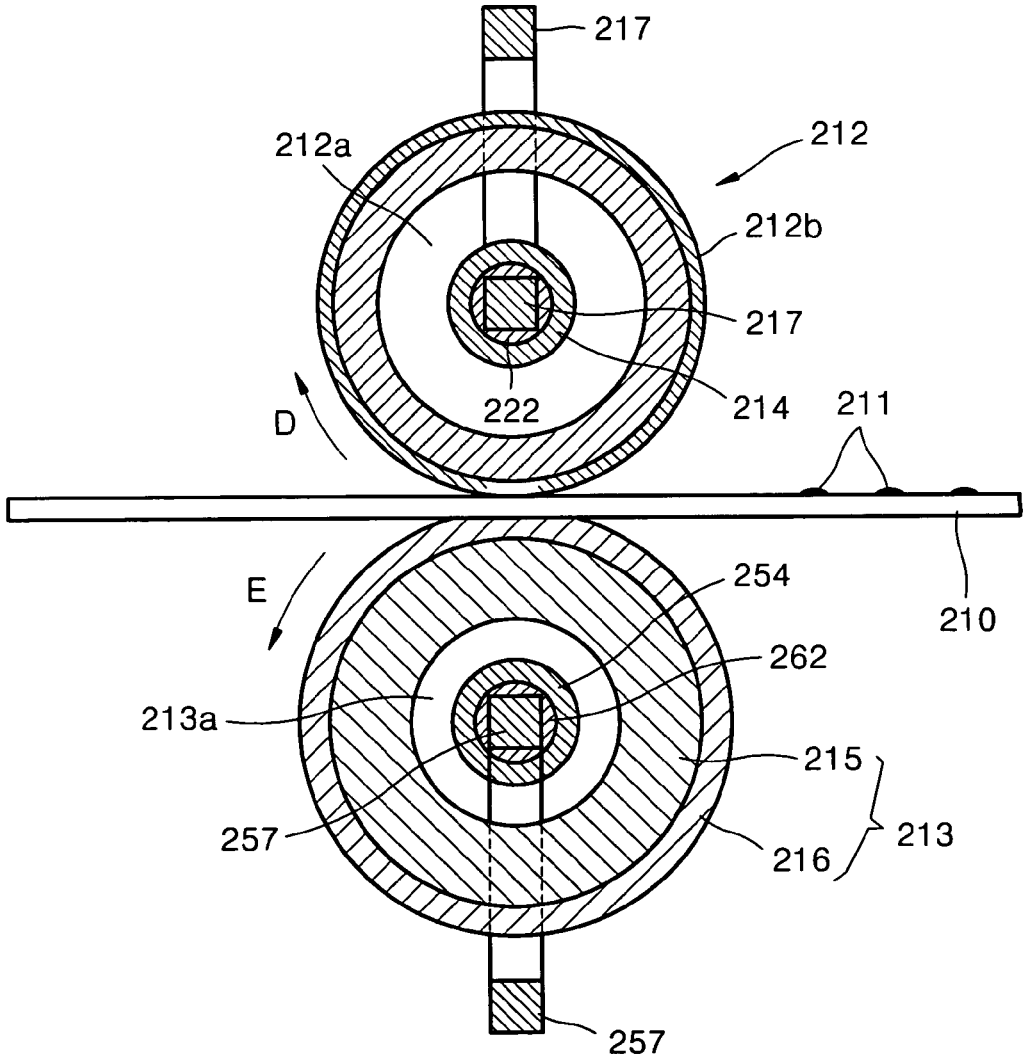
FIG. 6 is a cross-sectional view of a fusing device for an image forming apparatus according to another embodiment of the present invention.

FIG. 6 is a cross-sectional view of a fusing device of an electrophotographic image forming apparatus according to a second embodiment of the present invention. Referring to FIG. 6, the fusing device includes a cylindrical hollow fusing roller 212 installed to be rotatable by a driver (not shown) in order to thermally melt the toner 211 on a sheet of paper 210, a hollow pressure roller 213 pressing the sheet of paper 210 containing the toner 211 toward the fusing roller 212, and a first core 217, a portion of which, passes through a hollow portion 212*a* of the fusing roller 212. The fusing device further includes a first coil 214 wound around the circumference of the first core 217 in order to inductively heat the fusing roller 212, a second core 257, a portion of which, passes through the hollow portion 213*a* of the pressure roller 213, and a second coil 254 wound around the circumference of the second core 257 in order to inductively heat the pressure roller 213.

The fusing roller 212 can be a hollow pipe made of a conductive material, such as carbon steel, stainless alloy, aluminium, or iron. The fusing roller 212 can further include a Teflon coating layer 212*b* on the circumference thereof as a toner release layer contacting the toner on the sheet of paper. The fusing roller 212 can rotate in the direction D, and the pressure roller 213 can be rotated in the direction E by being engaged with the fusing roller 212, and not requiring an additional driver.

Like the fusing roller 212, the pressure roller 213 includes a cylindrical roller 215 made of a conductive material and a silicon rubber layer 216 formed on the circumference of the cylindrical roller 215. The pressure roller 213 can be pushed toward the fusing roller 212 by a spring member (not shown).

Each of the first and second cores 217 and 257 forms a closed magnetic circuit.

The first and second coils 214 and 254 are wound around the circumference of the first and second cores 217 and 257, respectively. The first and second coils 214 and 254 have a predetermined number of turns. Heat insulating layers 222 and 262, for example, mica sheets, are wound between the core 217 and the coil 214 and between the core 257 and the coil 254, respectively. The heat insulating layers 222 and 262 prevent heat produced at the fusing roller 212, the pressure roller 213 and the coils 214 and 254 from being transferred to the cores 217 and 257.

When an AC voltage is applied to the coils 214 and 254 from an AC power source (not shown), a magnetic flux produces an inductive current along the circumference of the fusing roller 212 and the pressure roller 213. The cores 217 and 257 can be iron cores having a high coercive coefficient as used in a general transformer.

The fusing roller 212 is inductively heated to a fusing temperature, for example, 180° C., by the AC voltage applied to the first coil 214. The iron core 215 of the pressure roller 213 is inductively heated by the AC voltage applied to the second coil 254, preferably, to a temperature lower than the temperature of the fusing roller 212, for example, 150° C.

The operation of the fusing device according to the second embodiment of the present invention will be described in greater detail below with reference to the appended drawings.

When an AC current with a frequency of tens or hundreds of Hz is applied to the coils 214 and 254 from an AC power source (not shown), the fusing roller 212 is heated by the low-frequency inductive heat to a temperature appropriate for fusing, for example, 180° C., while the pressure roller 213 is heated to a temperature lower than the temperature of the fusing roller 212, for example, 150° C.

When the sheet of paper 210 containing unfused toner 211 is fed into the fusing device maintained at a predetermined fusing temperature (between the fusing roller 212 and the pressure roller 213), the unfused toner 211 is melted by the heat generated at the fusing roller 212 and the pressure roller 213, and is thereby fixed on the sheet of paper 210 by the pressure of the pressure roller 213.

The fusing device according to the second embodiment of the present invention is advantageous in independently controlling the surface temperature of the fusing roller 212 and the pressure roller 213 by adjusting the number of turns of the first and second coils 214 and 254 and/or the AC voltage and the frequency applied to the first and second coils 214 and 254.

As described above, a fusing device for an image forming apparatus according to the present invention can reduce the time to reach a fusing temperature by heating both the fusing roller and the pressure roller which have hollow portions connected with a closed magnetic core. In addition, the present invention can be applied to a color laser printer, high-speed printer or a large-sheet (for example, A3 sheet) printer, which require an increased amount of fusing heat, because the heat absorbed by the pressure roller during toner fusing is reduced.

While the present invention has been particularly shown and described with reference to exemplary embodiments thereof, it will be understood by those of ordinary skill in the art that various changes in form and details can be made therein without departing from the spirit and scope of the present invention as defined by the following claims.

What is claimed is:

1. A fusing device for an image forming apparatus, comprising:

a cylindrical fusing roller;

a pressure roller disposed opposite to the fusing roller for pressing a sheet of paper passing therebetween; and at least one inductive heating element comprising a core passing through hollow portions of the fusing roller and the pressure roller, a portion of which passes along an axis of rotation of the fusing and pressure rollers, for simultaneously heating the fusing roller to a first temperature and the pressure roller to a second temperature, wherein the second temperature is less than the first temperature.

2. The fusing device of claim 1, wherein the core of the inductive heating element forms a closed magnetic circuit and further comprises a coil spirally wound around the circumference of the core.

3. The fusing device of claim 2, wherein the coil is wound around a portion of the core inside the hollow portion of the fusing roller.

4. The fusing device of claim 3, further comprising a heat insulating layer between the coil and the core.

5. A fusing device for an image forming apparatus, comprising:

a cylindrical fusing roller;

a pressure roller disposed opposite to the fusing roller for pressing a sheet of paper passing therebetween;

an element for heating the fusing roller to a first temperature, a portion of which passes along an axis of rotation of the fusing roller; and an element for heating the pressure roller to a second temperature, wherein the second temperature is less than the first temperature, a portion of which passes along an axis of rotation of the pressure roller.

6. The fusing device of claim 5, wherein the element heating the fusing roller comprises:

a first core, a portion of which passes through a hollow portion of the fusing roller forming a closed magnetic circuit; and a first coil spirally wound around the circumference of the first core.

7. The fusing device of claim 6, wherein the first coil is wound around a portion of the first core inside the hollow portion of the fusing roller.

8. The fusing device of claim 7, further comprising a heat insulating layer between the first coil and the first core.

9. The fusing device of claim 5, wherein the element heating the pressure roller comprises:

a second core passing through a hollow portion of the pressure roller forming a closed magnetic circuit; and a second coil spirally wound around the circumference of the second core.

10. The fusing device of claim 9, wherein the second coil is wound around a portion of the second core inside the hollow portion of the pressure roller.

11. The fusing device of claim 10, further comprising a heat insulating layer between the second coil and the second core.

* * * * *